US006074794A

United States Patent [19]

Fushimi et al.

[11] Patent Number: 6,074,794

[45] Date of Patent: Jun. 13, 2000

[54] TONER FOR DRY DEVELOPING

[75] Inventors: Hiroyuki Fushimi; Kohki Katoh; Masami Tomita; Yasuo Asahina; Tomomi Suzuki, all of Shizuoka-ken, Japan

[73] Assignee: Ricoh Company, Ltd., Tokyo, Japan

[21] Appl. No.: 09/113,566

[22] Filed: Jul. 10, 1998

[30] Foreign Application Priority Data

Jul. 10, 1997 [JP] Japan ..... 9-199125
Jul. 6, 1998 [JP] Japan ..... 10-204229

[51] Int. Cl.[7] ..... G03G 9/087

[52] U.S. Cl. ..... 430/109; 430/110

[58] Field of Search ..... 430/109, 111, 430/106

[56] References Cited

U.S. PATENT DOCUMENTS 5,501,931 3/1996 Hirama et al. ..... 430/109
5,736,288 4/1998 Kasuya et al. ..... 430/109

OTHER PUBLICATIONS

Diamond, Arthur S. Handbook of Imaging Materials. New York: Marcel–Dekker, Inc. pp. 168–9 & 178, 1991.

Macholdt, Hans–Tobias et al. "Charging Effects of Organic Pigments in Electrophotographic Toners" Dyes and Pigments 9, pp. 119–127, 1988.

Gregory, Peter. "The Role or Organic Molecules in Colour Hard Copy" Dyes and Pigments 13, pp. 251–268, 1990.

*Primary Examiner*—Christopher D. Rodee

*Attorney, Agent, or Firm*—Oblon, Spivak, McClelland, Maier & Neustadt, P.C.

[57] ABSTRACT

A toner for dry developing, containing a colorant and a binder and giving such a toner image on a transfer sheet upon fixation that has an image density I and a gross of G % when the toner deposits on the transfer sheet in an amount of M mg/cm$^2$, wherein I, G and M have the following relationship:

$$I=a\cdot M+b$$

where $0<a\leqq 3$ and $0\leqq b$, $$G=\alpha\cdot M+\beta$$

where $0<\alpha<15$ and $0\leqq\beta$, and $$G_{AV}\geqq 10$$

where $G_{AV}$ is an average of G when M=0.2, 0.4, 0.6, 0.8 and 1 mg/cm$^2$.

15 Claims, No Drawings

TONER FOR DRY DEVELOPING

BACKGROUND OF THE INVENTION

This invention relates to a toner used in electrophotography for developing a latent image by a dry developing method.

In full color copying devices using a dry developing method, yellow, magenta, cyan and black toners having a diameter of about 10 $\mu$m arc used. The thickness of toner images obtained with conventional toners varies with the color and color density thereof, so that the image surfaces are not smooth. Further, the gloss of the toner images increases with an increase of the amount of toners. Therefore, in the case of a portrait copy, for example, the skins have a low gloss whilst black hairs have a high gloss, so that the image quality is lowered. Additionally, the conventional toners have problems because the copies are apt to curl and because copied images, when contacted to a plastic sheet such as a polyvinyl chloride sheet, are apt to be transferred thereto.

SUMMARY OF THE INVENTION

It is, therefore, an object of the present invention to provide a toner for dry developing which-can give toner images having uniform gloss and good surface uniformity.

Another object of the present invention is to provide a toner of the above-mentioned type which can give copies free of curls and of image transfer when contacted with a plastic sheet.

It is a further object of the present invention to provide a toner of the above-mentioned type which can give sharp, clear toner images with good reproducibility.

In accomplishing the foregoing objects, there is provided in accordance with the present invention a toner for dry developing, comprising a colorant and a binder and giving a toner image on a transfer sheet upon fixation, the toner image having a density I and a gloss of G when the toner deposits on the transfer sheet in an amount of M mg/cm$^2$, the I, G and M having the following relationship:

$$I=a\cdot M+b$$

where $0<a\leqq 3$ and $0<b$, $$G=\alpha\cdot M+\beta$$

where $0<\alpha<15$ and $0<\beta$, and $$G_{AV}\geqq 10$$

where $G_{AV}$ is an average of G when M=0.2, 0.4, 0.6, 0.8 and 1.

Other objects, features and advantages of the present invention will become apparent from the detailed description of the preferred embodiments of the invention to follow.

DETAILED DESCRIPTION OF THE PREFERRED EMBODIMENTS OF THE INVENTION

A toner according to the present invention gives a toner image, upon fixation on a transfer sheet, having an image density I, a gloss of G % and a toner deposition of M mg/cm$^2$, such that I, G and M have the following relationship:

$$I=a\cdot M+b$$

where $0<a\leqq 3$, preferably $1.5\leqq a\leqq 2.6$, and $0\leqq b$, preferably $0.2\leqq b\leqq 0.6$ $$G=\alpha\cdot M+\beta$$

where $0<\alpha<15$, preferably $7\leqq\alpha\leqq 13$, more preferably $10\leqq\alpha\leqq 12$, and $0\leqq\beta$, preferably $3\leqq\beta\leqq 10$, and $$G_{AV}\geqq 10\%$$

where $G_{AV}$ is an average of G when M=0.2, 0.4, 0.6, 0.8 and 1 mg/cm$^2$.

By this expedient, the toner gives both a desired image density and a stable, uniform gloss.

When "a" is greater than 3, image reproducibility of a half tone becomes poor and, further, a half tone image has a so small toner deposition that the gloss of the image becomes non-uniform, though a high image density is obtainable even with a small toner deposition amount M. Thus, a value "a" greater than 3 fails to give a high quality image.

When $\alpha$ is greater than 15, the gloss of a toner image is non-uniform, i.e. a difference in gloss between half tone portions and solid pattern portions is large.

A value of $G_{AV}$ below 10% is insufficient to obtain a satisfactory image quality. When the $G_{AV}$ value is more than 40%, the toner deposition amount M has a so significantly large influence upon the gloss that the image quality becomes lowered.

The image density I (no unit), gloss G (%) and toner deposition amount M (mg/cm$^2$) are measured as follows:

A solid pattern of 3 cm×8 cm is copied and fixed on a transfer sheet with each of various toner deposition amounts M of 0.2, 0.4, 0.6, 0.8 and 1 mg/Cm$^2$. The fixation is performed at a line speed of 180 mm/sec and a temperature of 160° C. with silicone-coated rollers having a nip width of 10 mm. Each fixed image is measured for image density and gloss thereof. The image density I is measured using Spectro Densitometer 938 (manufactured by X-Rite Inc.). The image density measurement is repeated five times in total for each deposition amount and an average thereof is used as I. The gloss G is measured using Digital Gloss Meter VSG-1D (manufactured by Nippon Denshoku Kogyo K. K.) at an incident angle of 60°. The image gloss measurement is repeated five times in total for each deposition amount and an average thereof is used as G. The image density I (ordinate) is plotted against the toner deposition amount M (abscissa). A straight line (approximation) representing a relationship between I and M is drawn, from which "a" and "b" are determined. Similarly, the image gloss G (ordinate) is plotted against the toner deposition amount M (abscissa). A straight line (approximation) representing a relationship between G and M is drawn, from which "$\alpha$" and "$\beta$" are determined. The average of G at respective deposition amounts is calculated to obtain $G_{AV}$ (%) as follows:

$$G_{AV}=(G_{0.2}+G_{0.4}+G_{0.6}+G_{0.8}G_{1.0})\ /5$$

where $G_{0.2}G_{0.4}$, $G_{0.6,}$ $G_{0.8}$ and $G_{1.0}$ are gloss values at deposition amounts of 0.2, 0.4, 0.6, 0.8 and 1.0 mg/cm$^2$, respectively.

To obtain the toner satisfying the above conditions, it is preferred that two, first and second resins be used in combination as the binder for the toner, wherein the second resin has a glass transition point different from that of the first resin and greater by no more than 5° C. than that of the first resin.

The first resin is preferably a polyol resin which is either (A) a resin having (i) a main skeleton containing an epoxy resin unit and an alkylene oxide unit and (ii) inert terminal ends, or (B) a resin obtained by reacting (a) an epoxy resins (b) an alkylene oxide addition product of a dihydric phenol compound or a glycidyl ether of the product, (c) a compound having one active hydrogen capable of reacting with the epoxy resin (a), and (d) a compound having at least two active hydrogen capable of reacting with the epoxy resin (a).

The resin (A) having (i) a main skeleton containing an epoxy resin unit and an alkylene oxide unit and (ii) inert terminal ends may be obtained, for example, by reacting an epoxy resin having glycidyl groups at both termini thereof with an alkylene oxide addition product of a dihydric phenol having glycidyl groups at both termini thereof and with at least one compound selected from a dihalide, a diisocyanate, a diamine, a diol, a polyhydric phenol and a dicarboxylic acid. The polyhydric phenol is preferably a dihydric phenol or a mixture of a dihydric phenol with 10–15% by weight of other polyhydric phenol or a polycarboxylic acid.

The epoxy resin (a) is preferably a condensation product of a bisphenol such as bisphenol A or bisphenol F with epichlorohydrin. For reasons of suitable gloss, storage stability and fixation efficiency, it is preferred that the epoxy resin be a mixture of at least two different bisphenol A epoxy resins including 20–50% by weight of a low molecular weight bisphenol A epoxy resin having a number average molecular weight of 360–2,000 and 5–40% by weight of a high molecular weight bisphenol A epoxy resin having a number average molecular weight of 3,000–10,000.

The alkylene oxide addition product (b) of a dihydric phenol compound may be a product obtained by reacting ethylene oxide, propylene oxide, butylene oxide or a mixture thereof with a bisphenol such as bisphenol A or bisphenol F. The product is preferably converted into a diglycidyl ether with epichlorohydrin or β-methylepichlorohydrin. The use of the following diglycidyl ether is particularly preferred.

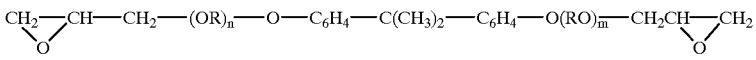

wherein R represents $—CH_2—CH_2—$, $—CH_2—CH(CH_3)—$ or $—CH_2—CH_2—CH_2—$ and m and n are each an integer of 1 or more provided that (m+n) is not greater than 6.

The alkylene oxide addition product of a dihydric phenol compound or a diglycidyl ether of the product (b) is preferably used in an amount of 10–40% by weight based on the weight of the polyol resin for reasons of prevention of curls.

The compound (c) having one active hydrogen capable of reacting with the above epoxy resin (a) may be, for example, a monohydric phenol compound such as phenol, cresol, isopropylphenol, nonylphenol, dodecylphenol, xylenol or p-cumylphenol; a secondary amine such as diethylamine, dipropylamine, dibutylamine, N-methyl(ethyl)piperazine or piperidine; or a carboxylic acid such as propionic acid or caproic acid.

The compound (d) having at least two active hydrogen capable of reacting with the above epoxy resin (a) may be, for example, a dihydric phenol such as bisphenol A, bisphenol F or the like bisphenol; a polyhydric phenol such as an o-cresol novolak resin, a phenol novolak resin, tris(4-hydroxyphenyl)methane, 1-[α-methyl-α-(4-hydroxyphenyl)ethyl]benzene; or a polycarboxylic acid such as malonic acid, succinic acid, glutaric acid, adipic acid, maleic acid, fumaric acid, phthalic acid, terephthalic acid, trimelitic acid or trimelitic anhydride.

The first resin preferably has a softening point of 100–120° C. for reasons of easiness in controlling the particle distribution of the toner particles. Further, the first resin preferably has a glass transition point Tg of at least 55° C. for reasons of storage stability of the toner.

The softening point in the present specification is as measured by the following method using a fully automatic dropping device FP5/FP53 (manufactured by Metra Inc.): Sample is placed in a crucible and maintained in a melted state for 20 minutes. The melt is poured into a sample cup (opening diameter: 6.35 mm) and allowed to be cooled to room temperature. The cup is then placed in a cartridge. A FP5 control unit is set at a predetermined heating rate (1° C./min) and a predetermined measurement commencing temperature (lower by 15° C. than an expected softening point). The sample-containing cartridge is mounted on a P53 furnace and start lever is ON 30 seconds after the mounting of the cartridge, thereby starting the measurement. The measurement is performed in a fully automatic manner. A softening point (Sp') is indicated on an indicating panel of the control unit FP5. When the measured softening point is not greater by 15° C. than the expected softening point, the measurement should be again performed. The value Sp', when added with a correction value, correspond to a softening point as measured by the Durran's mercury method.

The glass transition point Tg in the present specification is as measured by the following method using a differential scanning calorimeter DSC-200 (manufactured by Seiko Electronic Inc.); Ground sample (10 mg±1 mg) is placed in an aluminum sample vessel and the vessel is closed with an aluminum lid. The glass transition point is measured by the OSC method in the atmosphere of nitrogen. Thus, the sample is heated from room temperature to 150° C. at a heating rate of 20° C./minute and maintained at that temperature for 10 minutes. Then the temperature is lowered to 0° C. at a cooling rate of 50° C./minute and maintained at that temperature for 10 minutes. The temperature is again raised to 150° C. at a heating rate of 20° C./minute while feeding nitrogen at a flow rate of 20 cc/minute. The glass transition point (peak leading edge) is determined using an analyzing software (Tg Job).

The second resin used in conjunction with the first resin preferably is a styrene-acrylic copolymer having a number average molecular weight Mn of 3,000–30,000, a weight average molecular weight Mw of 9,000–50,000 and a ratio of Mw/Mn of no more than 3 for reasons of easiness of preparation of toner particles, prevention of curls and suitable gloss. The copolymer may be obtained by copolymerizing a styrene compound with an acrylic or methacrylic acid or an ester thereof.

Illustrative of suitable styrene compounds are styrene, α-methylstyrene, o-methylstyrene, m-methylstyrene, p-methylstyrene, 2,4-dimethylstyrene, 3,4-dimethylstyrene. Illustrative of suitable acrylic or methacrylic acid esters are acrylic acid, ethyl acrylate, methyl acrylate, propyl acrylate, n-butyl acrylate, isobutyl acrylate, dodecyl acrylate, 2-ethylhexyl acrylate, methacrylic acid, methyl methacrylate, ethyl methacrylate, propyl methacrylate, n-butyl methacrylate, isobutyl methacrylate, dodecyl methacrylate and 2-ethylhexyl methacrylate.

Examples of the styrene-acrylic copolymers include styrene-acrylic acid copolymers, styrene-methyl methacrylate copolymers, styrene-n-butyl acrylate copolymers, styrene-diethylaminoethyl methacrylate copolymers, styrene-methyl methacrylate-n-butylacrylate copolymers, styrene-methyl methacrylate-butyl acrylate-N-(methoxymethyl)acrylamide copolymers, styrene-glycidyl methacrylate copolymers, styrene-dimethylaminoethyl methacrylate copolymers, styrene-diethylaminoethyl methacrylate copolymers, styrene-butadiene-acrylic ester copolymers, styrene-butadiene-chlorinated paraffin copolymers, styrene-butadiene-dimethylaminoethyl methacrylate copolymers, styrene-acrylic ester-maleic ester copolymers, styrene-n-butyl acrylate-2-ethylhexyl acrylate copolymers, styrene-methyl methacrylate-2-ethylhexyl acrylate copolymers, styrene-n-butyl acrylate-ethylglycol methacrylate copolymers and styrene-n-butylmethacrylate-acrylic acid copolymers.

The weight ratio of the first resin to the second resin is preferably in the range of 95:5 to 60:40 for reasons of fixation efficiency, prevention of image transfer to a polyvinyl chloride sheet and suitable gloss. The first resin is preferably not compatible with the second resin.

The mixture of the first and second resins may preferably contain a finely divided wax used for improving offset resistance so that the fixation of the image on a transfer sheet can be performed without using fluororubber-coated fixation rollers or applying a lubricating oil on the surfaces of fixation rollers. The wax preferably has an average particle diameter of 0.2–0.5 μm. The use of an ester-type or olefin-type wax is preferred. Illustrative of suitable waxes are natural waxes such as carnauba wax, candelilla wax and rice wax, mineral waxes such as montan wax, and synthetic waxes such as polyethylene wax and polypropylene wax.

It is preferred that the toner according to the present invention have a volume average particle diameter of 5–9 μm and such a particle size distribution of toner particles that particles having a diameter of 4 μm or less account for no more than 40% of the total number of the toner particles and particles having a diameter of at least 12 μm account for no more than 10% of the total volume of the toner particles.

When the volume average particle diameter exceeds 9 μm, toner dispersion of the image tends occur so that the image tends to lack sharpness, especially when two or more toner images having different colors are superimposed one over the other to form a full color image. Additionally, color reproducibility tends to be lowered in half tone portions of the image. On the other hand, when the volume average particle diameter is smaller than 5 μm or when particles having a diameter of 4 μm or less are present in an amount of more than 40% of the total number of the toner particles, the toner is apt to be excessively charged so that the developing efficiency is lowered. Further, image reproducibility tends to be lowered. When particles having a diameter of at least 12 μm are present in an amount of more than 10% of the total volume of the toner particles, image reproducibility tends to be lowered.

The particle diameter herein is measured as follows. Sample toner (10 mg) is added in 1% aqueous sodium chloride solution (50 ml) containing a surfactant and the mixture is sonicated to obtain a dispersion. The dispersion is measured for the particle diameter using COULTER COUNTER MODEL TA II in combination with COULTER MULTISIZER (both manufactured by Coulter Electronics Ltd.).

In the case of a black toner according to the present invention, it is preferred that the colorant be present in an amount of 3–12% by weight based on the weight of the toner and consist of carbon black and at least one additional colorant selected from the group consisting of yellow colorants, magenta colorants and cyan colorants, the additional colorant being present in an amount of 10–30% by weight based on the weight of the carbon black. In the case of a yellow toner, it is preferred that a yellow colorant be present in an amount of 4–10% by weight based on the weight of the toner. In the case of a magenta toner, it is preferred a magenta colorant be present in an amount of 4–10% by weight based on the weight of the toner. In the case of a cyan toner, it is preferred that a cyan colorant be present in an amount of 1–5% by weight based on the weight of the toner.

By using the above toners in combination, full color copies with satisfactory color density, gloss and half tone color reproducibility are obtainable.

Any known colorant may be used for the purpose of the invention. The yellow colorant may be, for example, Naphthol Yellow S, Hansa Yellow (10G, 5G, G, GR, A, RN and R), cadmium yellow, Chinese yellow, chrome yellow, yellow iron oxide, titanium yellow, Polyazo Yellow, Oil Yellow, Pigment Yellow L, Benzidine Yellow (G and GR), Permanent Yellow NCG, Vulcan Fast Yellow, Tartradine Lake, Quinoline Yellow Lake, Anthrazan Yellow BGL, benzimidazolon yellow or Isoindolinone Yellow. The magenta colorant may be, for example, red iron oxide, red lead, lead vermilion, cadmium red, cadmium mercury red, antimony vermilion, Permanent Red 4R, Para Red, Fisay Red, parachloro-orthonitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Lubin B, Brilliant Scarlet G, Lithol Lubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosin Lake, Rhodamine Lake B, Rhodamine Lake Y. Alizarine Lake, Thioindigo Red B, Thioindigo Maroon, Oil Red, Quinacridon Red, Pyrazolon Red, Polyazo Red, chrome vermilion, Benzidine Orange, Perinon Orange or Oil Orange. The cyan colorant may be, for example, Cobalt Blue, Selulian Blue, Alkali Blue Lake, Peacock Blue Lake, Victoria Blue Lake, non-metal Phthalocyanine Blue, Phthalocyanine Blue, Fast Sky Blue, Indanthrene Blue (RS and BC), Indigo, Iron Blue, Ultramarine Blue, Anthraquinone Blue, Fast Violet B, Methyl Violet Lake, Cobalt Vilet, Manganese Violet, Dioxan Violet, Anthraquinone Violet, Chrome Green, Zinc Green, chromium oxide, Pylidian, Emerald Green, Pigment Green B, Naphthol Green B, Green Gold, Acid Green Lake, Marakite Green Lake, Phthalocyanine Green or Anthraquinone Green. Other colorants such as titanium oxide, Chinese White or Lithopone, a nigrosine dye and iron black may also be used. The black colorant is a combination of carbon black with the above colorant.

If desired, the toner may contain one or more additives such as a charge controlling agent. The charge controlling agent may be, for example, a nigrosin dye, a triphenylmethane dye, a chromium complex dye, a molybdate chelate pigment, a rhodamine dye, an alkoxy amine, a quaternary ammonium salt, a fluorinated quaternary ammonium salt, an alkylamide, phosphorus, a phosphorus compound, tungsten, a tungsten compound, a fluorine-containing surfactant, a metal salt of salicylic acid or a metal salt of a salicylic acid derivative. Illustrative of other additives are a lubricant such as a fluorine-containing polymer (e.g. tetrafluoroethylene), a metal salt of a fatty acid (e.g. zinc stearate or aluminum stearate) or a metal oxide (e.g. aluminum oxide, tin oxide or antimony oxide); an abrasive such as cerium oxide or silicon carbide; and a fixation adjuvant such as a low molecular weight polyolefin.

The toner of the present invention may be suitably used as a single-component-type development system or as a two-component-type developing system in conjunction with carrier particles which may be (a) magnetic particles such as of metals, compounds and alloys of iron, cobalt and nickel, e.g. ferrite, (b) glass beads or (c) composite particles composed of the above magnetic particles or glass beads each coated with a layer of a resin such as polyfluorocarbon, polyvinyl chloride, polyvinylidene chloride, a phenol resin polyvinyl acetal or a silicone resin. The weight ratio of the carrier particles to the toner particles is generally 1000:5 to 100:6.

The toner according to the present invention may be used for developing an electrostatic latent image on a photosensitive support. The development may be carried out by electrostatically or magnetically depositing the toner on the latent image in any known manner. The developed toner image is finally transferred to a transfer sheet such as paper and thermally fixed thereon. The fixation may be performed with or without applying a pressure to the image-bearing sheet.

The following examples will further illustrate the present invention. Parts are by weight.

PREPARATION EXAMPLE 1

In a separable flask equipped with a stirrer, a thermometer, a $N_2$ feed port and a condenser, 378.4 g of a low molecular weight bisphenol A epoxy resin (number average molecular weight: about 360), 86.0 g of a high molecular weight bisphenol A epoxy resin (number average molecular weight: about 2,700), 191.0 g of a diglycidyl ether of a bisphenol A propylene oxide adduct (compound of formula (I) in which (n+m) is about 2.1), 274.5 g of bisphenol F, 70.1 g of p-cumylphenol and 200 g of xylene were charged. After the contents in the flask had been heated to 70–100° C. in the nitrogen atmosphere, 0.1839 g of lithium chloride was added. The mixture was then heated to 160° C. and the xylene was removed in vacuo. The resulting mixture was then polymerized at 180° C. for 6–9 hours to obtain 1,000 g of a polyol resin (Resin 1) having a softening point of 109° C. and Tg of 58° C.

PREPARATION EXAMPLE 2

In a separable flask equipped with a stirrer, a thermometer, a $N_2$ feed port and a condenser, 205.3 g of a low molecular weight bisphenol A epoxy resin (number average molecular weight: about 360), 54.0 g of a high molecular weight bisphenol A epoxy resin (number average molecular weight: about 3,000), 432.0 g of a diglycidyl ether of a bisphenol A propylene oxide adduct (compound of formula (I) in which (n+m) is about 2.2), 282.7 g of bisphenol F, 26.0 g of p-cumylphenol and 200 g of xylene were charged. After the contents in the flask had been heated to 70–100° C. in the nitrogen atmosphere, 0.183 g of lithium chloride was added. The mixture was then heated to 160° C. and the xylene was removed in vacuo. The resulting mixture was then polymerized at 180° C. for 6–9 hours to obtain 1,000 g of a polyol resin (Resin 2) having a softening point of 109° C. and Tg of 58° C.

PREPARATION EXAMPLE 3

In a separable flask equipped with a stirrer, a thermometer, a $N_2$ feed port and a condenser, 289.9 g of a low molecular weight bisphenol A epoxy resin (number average molecular weight: about 2,400), 232.0 g of a high molecular weight bisphenol A epoxy resin (number average molecular weight: about 10,000), 309.0 g of a diglycidyl ether of a bisphenol A ethylene oxide adduct (compound of formula (I) in which (n+m) is about 6.0), 117.5 g of bisphenol A, 51.6 g of p-cumylphenol and 200 g of xylene were charged. After the contents in the flask had been heated to 70–100° C. in the nitrogen atmosphere, 0.183 g of lithium chloride was added. The mixture was then heated to 160° C. and the xylene was removed in vacuo. The resulting mixture was then polymerized at 180° C. for 6–9 hours to obtain 1,000 g of a polyol resin (Resin 3) having a softening point of 116° C. and Tg of 61° C.

PREPARATION EXAMPLE 4

In a separable flask equipped with a stirrer, a thermometer, a $N_2$ feed port and a condenser, 421.5 g of a low molecular weight bisphenol A epoxy resin (number average molecular weight: about 680), 107.0 g of a high molecular weight bisphenol A epoxy resin (number average molecular weight: about 6,500), 214.0 g of a diglycidyl ether of a bisphenol A ethylene oxide adduct (compound of formula (I) in which (n+m) is about 2.0), 210.0 g of bisphenol F, 47.5 g of p-cumylphenol and 200 g of xylene were charged. After the contents in the flask had been heated to 70–100° C. in the nitrogen atmosphere, 0.183 g of lithium chloride was added. The mixture was then heated to 160° C. and the xylene was removed in vacuo. The resulting mixture was then polymerized at 180° C. for 6–9 hours to obtain 1,000 g of a polyol resin (Resin 4) having a softening point of 114° C. and Tg of 60° C.

PREPARATION EXAMPLE 5

In a separable flask equipped with a stirrer, a thermometer, a $N_2$ feed port and a condenser, 365.5 g of a low molecular weight bisphenol A epoxy resin (number average molecular weight: about 460), 150.4 g of a high molecular weight bisphenol A epoxy resin (number average molecular weight; about 6,500), 98.6 g of a diglycidyl ether of a bisphenol A ethylene oxide adduct (compound of formula (I) in which (n+m) is about 2.2), 167.4 g of bisphenol F, 48.3 g of p-cumylphenol and 200 g of xylene were charged. After the contents in the flask had been heated to 70–100° C. in the nitrogen atmosphere, 0.183 g of lithium chloride was added. The mixture was then heated to 160° C. and the xylene was removed in vacuo. The resulting mixture was then polymerized at 180° C. for 6–9 hours to obtain 1,000 g of a polyol resin (Resin 5) having a softening point of 102° C. and Tg of 53° C.

EXAMPLE 1

The following yellow, magenta, cyan and black toner compositions were prepared using Resin 1 shown above and Resin A (Resin A is a styrene-n-butyl methacrylate copolymer having a number average molecular weight Mn of 5,500, a weight average molecular weight Mn of 12,000, Mw/Mn of 2.2, Tg of 61° C. and a softening point of 110° C.):

Yellow toner composition:

| | |
|---|---|
| Resin 1 | 80 parts |
| Resin A | 20 parts |
| Benzidine Yellow | 5 parts |

-continued

| | |
|---|---|
| Zinc salt of salicylic acid compound | 1 part |
| Magenta toner composition: | |
| Resin 1 | 80 parts |
| Resin A | 20 parts |
| Qyinacridone Red | 5 parts |
| Zinc salt of salicylic acid compound | 2 parts |
| Cyan toner composition: | |
| Resin 1 | 80 parts |
| Resin A | 20 parts |
| Copper Phthalocyanine Blue | 2 parts |
| Zinc salt of salicylic acid compound | 2 parts |
| Black toner composition: | |
| Resin 1 | 80 parts |
| Resin A | 20 parts |
| Carbon Black | 8 parts |
| Copper Phthalocyanine Blue | 1 part |
| Zinc salt of salicylic acid compound | 2 parts |

Each of the above toner compositions was mixed with Henschel mixer and kneaded with a roll mill at 100° C. for 30 minutes. Each kneaded mixture was cooled,, ground with a hammer mill, finely pulverized with an air jet mill and then treated with a wind sieve device to remove extremely fine powder, thereby obtaining yellow, magenta, cyan and black toners having the particle distribution shown in Table 1 below.

TABLE 1

| Toner | Yellow | Magenta | Cyan | Black |
|---|---|---|---|---|
| Volume average particle diameter (μm) | 7.5 | 7.3 | 7.5 | 7.9 |
| Number of particles with diameter of 4 μm or less (%) | 32.0 | 35.0 | 29.0 | 25.0 |
| Volume of particles with diameter of 12 μm or more (%) | 2.0 | 1.0 | 0.0 | 0.0 |

Each of the yellow, magenta, cyan and black toners (100 parts) was mixed with 0.5 part of hydrophobic silica with Henschel mixer and the mixture (5 parts) was mixed with 95 parts of a resin-coated ferrite carrier to obtain yellow, magenta, cyan and black two-component developers. Respective developers were charged in a commercially available digital full color copying machine (PRETER650 manufactured by Ricoh Company Ltd.). Solid patterns each having an area of 3 cm×8 cm were then produced with various toner deposition amounts of 0.2, 0.4, 0.6, 0.8 and 1.0 mg/cm$^2$ for respective colors. The fixation of the toner images was performed at 160° C., with a silicone roller with an application of an silicone oil at a linear speed of 180 mm/sec. Each of the images was measured for the density I and gloss G thereof. From the results of the measurement, the variable a, b, α and β were determined. The values a, b, α and $G_{AV}$ are shown in Table 2.

TABLE 2

| Developer | Yellow | Magenta | Cyan | Black |
|---|---|---|---|---|
| a | 1.5 | 1.8 | 1.9 | 1.9 |
| b | 0.2 | 0.3 | 0.3 | 0.5 |
| α | 7.5 | 8.0 | 8.9 | 9.3 |
| $G_{AV}$ | 14.0 | 15.0 | 15.0 | 13.0 |

EXAMPLE 2

The following yellow, magenta, cyan and black toner compositions were prepared using Resin 2 shown above and Resin A:

| | |
|---|---|
| Yellow toner composition: | |
| Resin 2 | 70 parts |
| Resin A | 30 parts |
| Benzimidazolon Yellow | 5 parts |
| Zinc salt of salicylic acid compound | 2 part |
| Magenta toner composition: | |
| Resin 2 | 70 parts |
| Resin A | 30 parts |
| Brilliant Carmine 6B | 5 parts |
| Zinc salt of salicylic acid compound | 2 parts |
| Cyan toner composition: | |
| Resin 2 | 70 parts |
| Resin A | 30 parts |
| Copper Phthalocyanine Blue | 2 parts |
| Zinc salt of salicylic acid compound | 2 parts |
| Black toner composition: | |
| Resin 2 | 70 parts |
| Resin A | 30 parts |
| Carbon Black | 8 parts |
| Copper Phthalocyanine Blue | 1 part |
| Zinc salt of salicylic acid compound | 2 parts |

Each of the above toner compositions was mixed with Henschel mixer and kneaded with a roll mill at 100° C. for 30 minutes. Each kneaded mixture was cooled, ground with a hammer mill, finely pulverized with an air jet mill and then treated with a wind sieve device to remove extremely fine powder, thereby obtaining yellow, magenta, cyan and black toners having the particle distribution shown in Table 3 below.

TABLE 3

| Toner | Yellow | Magenta | Cyan | Black |
|---|---|---|---|---|
| Volume average particle diameter (μm) | 8.5 | 8.0 | 8.3 | 8.1 |
| Number of particles with diameter of 4 μm or less (%) | 22.0 | 23.0 | 27.0 | 20.0 |
| Volume of particles with diameter of 12 μm or more (%) | 0.0 | 0.0 | 0.0 | 0.0 |

Each of the yellow, magenta, cyan and black toners (100 parts) was mixed with 0.7 part of hydrophobic silica with Henschel mixer and the mixture (5 parts) was mixed with 95 parts of a resin-coated ferrite carrier to obtain yellow, magenta, cyan and black two-component developers.

Respective developers were charged in a commercially available digital full color copying machine (PRETER650 manufactured by Ricoh Company Ltd.). Solid patterns each having an area of 3 cm×8 cm were then produced with various toner deposition amounts of 0.2, 0.4, 0.6, 0.8 and 1.0 mg/cm$^2$ for respective colors. The fixation of the toner images was performed at 160° C., with a silicone roller with an application of an silicone oil at a linear speed of 180 mm/sec. Each of the images was measured for the density I and gloss G thereof. From the results of the measurement, the variable a, b, α and β were determined. The values a, b, α and $G_{AV}$ are shown in Table 4.

TABLE 4

| Developer | Yellow | Magenta | Cyan | Black |
|---|---|---|---|---|
| a | 1.5 | 1.8 | 1.9 | 1.9 |
| b | 0.2 | 0.3 | 0.3 | 0.5 |
| α | 7.5 | 8.0 | 8.9 | 9.3 |
| $G_{AV}$ | 12.0 | 13.0 | 12.0 | 14.0 |

EXAMPLE 3

The following yellow, magenta, cyan and black toner compositions were prepared using Resin 3 shown above and Resin B (Resin B is a styrene-methyl methacrylate copolymer having a number average molecular weight Mn of 12,200, a weight average molecular weight Mw of 29,400, Mw/Mn of 2.4, Tg of 63° C. and a softening point of 125° C.):

| | |
|---|---|
| Yellow toner composition: | |
| Resin 3 | 75 parts |
| Resin B | 25 parts |
| Benzimidazolon Yellow | 6 parts |
| Zinc salt of salicylic acid compound | 2 part |
| Magenta toner composition: | |
| Resin 3 | 75 parts |
| Resin B | 25 parts |
| Brilliant Carmine 6B | 3 parts |
| Permanent Red FBB | 3 parts |
| Zinc salt of salicylic acid compound | 3 parts |
| Cyan toner composition: | |
| Resin 3 | 75 parts |
| Resin B | 25 parts |
| Copper Phthalocyanine Blue | 3 parts |
| Zinc salt of salicylic acid compound | 3 parts |
| Black toner composition: | |
| Resin 3 | 75 parts |
| Resin B | 25 parts |
| Carbon Black | 9 parts |
| Copper Phthalocyanine Blue | 1 part |
| Zinc salt of salicylic acid compound | 3 parts |

Each of the above toner compositions was mixed with Henschel mixer and kneaded with a roll mill at 100° C. for 30 minutes. Each kneaded mixture was cooled, ground with a hammer mill, finely pulverized with an air jet mill and then treated with a wind sieve device to remove extremely fine powder, thereby obtaining yellow, magenta, cyan and black toners having the particle distribution shown in Table 5 below.

TABLE 5

| Toner | Yellow | Magenta | Cyan | Black |
|---|---|---|---|---|
| Volume average particle diameter (μm) | 6.2 | 5.6 | 5.3 | 6.9 |
| Number of particles with diameter of 4 μm or less (%) | 36.0 | 38.0 | 37.0 | 29.0 |
| Volume of particles with diameter of 12 μm or more (%) | 0.0 | 0.0 | 0.0 | 1.0 |

Each of the yellow, magenta, cyan and black toners (100 parts) was mixed with 0.7 part of hydrophobic silica with Henschel mixer and the mixture (5 parts) was mixed with 95 parts of a resin-coated ferrite carrier to obtain yellow, magenta, cyan and black two-component developers. Respective developers were charged in a commercially available digital full color copying machine (PRETER650 manufactured by Ricob Company Ltd.). Solid patterns each having an area of 3 cm×8 cm were then produced with various toner deposition amounts of 0.2, 0,4, 0.6, 0.8 and 1.0 mg/cm$^2$ for respective colors. The fixation of the toner images was performed at 160° C., with a silicone roller with an application of an silicone oil at a linear speed of 180 mm/sec. Each of the images was measured for the density I and gloss G thereof. From the results of the measurement, the variable a, b, α and β were determined. The values a, b, α and $G_{AV}$ are shown in Table 6.

TABLE 6

| Developer | Yellow | Magenta | Cyan | Black |
|---|---|---|---|---|
| a | 2.1 | 2.6 | 2.3 | 2.6 |
| b | 0.2 | 0.5 | 0.6 | 0.6 |
| α | 10.5 | 11.6 | 13.0 | 12.8 |
| $G_{AV}$ | 16.0 | 15.0 | 16.0 | 17.0 |

EXAMPLE 4

The following yellow, magenta, cyan and black toner compositions were prepared using Resin 4shown above and Resin A:

| | |
|---|---|
| Yellow toner composition: | |
| Resin 4 | 80 parts |
| Resin A | 20 parts |
| Benzimidazolon Yellow | 6 parts |
| Zinc salt of salicylic acid compound | 2 parts |
| Magenta toner composition: | |
| Resin 4 | 80 parts |
| Resin A | 20 parts |
| Brilliant Carmine 6B | 3 parts |
| Permanent Red FBB | 5 parts |
| Zinc salt of salicylic acid compound | 3 parts |
| Cyan toner composition: | |
| Resin 4 | 80 parts |
| Resin A | 20 parts |
| Copper Phthalocyanine Blue | 3 parts |
| Zinc salt of salicylic acid compound | 3 parts |
| Black toner composition: | |

-continued

| | |
|---|---|
| Resin 4 | 80 parts |
| Resin A | 20 parts |
| Carbon Black | 9 parts |
| Copper Phthalocyanine Blue | 1 part |
| Zinc salt of salicylic acid compound | 3 parts |

Each of the above toner compositions was mixed with Henschel mixer and kneaded with a roll mill at 100° C. for 30 minutes. Each kneaded mixture was cooled, ground with a hammer mill, finely pulverized with an air jet mill and then treated with a wind sieve device to remove extremely fine powder, thereby obtaining yellow, magenta, cyan and black toners having the particle distribution shown in Table 7 below.

TABLE 7

| Toner | Yellow | Magenta | Cyan | Black |
|---|---|---|---|---|
| Volume average particle diameter (μm) | 6.9 | 6.8 | 6.2 | 7.4 |
| Number of particles with diameter of 4 μm or less (%) | 32.0 | 34.0 | 30.0 | 27.0 |
| Volume of particles with diameter of 12 μm or more (%) | 0.0 | 0.0 | 0.0 | 2.0 |

Each of the yellow, magenta, cyan and black toners (100 parts) was mixed with 0.5 part of hydrophobic silica with Henschel mixer and the mixture (5 parts) was mixed with 95 parts of a resin-coated ferrite carrier to obtain yellow, magenta, cyan and black two-component developers. Respective developers were charged in a commercially available digital full color copying machine (PRETER650 manufactured by Ricoh Company Ltd.). Solid patterns each having an area of 3 cm×9 cm were then produced with various toner deposition amounts of 0.2, 0.4, 0.6, 0.8 and 1.0 mg/cm$^2$ for respective colors. The fixation of the toner images was performed at 160° C., with a silicone roller with an application of an silicone oil at a linear speed of 180 mm/sec. Each of the images was measured for the density I and gloss G thereof. From the results of the measurement, the variable a, b, α and β were determined. The values a, b, α and $G_{AV}$ are shown in Table 8.

TABLE 8

| Developer | Yellow | Magenta | Cyan | Black |
|---|---|---|---|---|
| a | 1.9 | 2.3 | 2.5 | 2.5 |
| b | 0.2 | 0.5 | 0.6 | 0.5 |
| α | 9.6 | 10.7 | 11.5 | 12.8 |
| $G_{AV}$ | 12.0 | 13.0 | 12.0 | 14.0 |

COMPARATIVE EXAMPLE 1

The following yellow, magenta, cyan and black toner compositions were prepared using Resin 5 shown above and Resin A;

| | |
|---|---|
| Yellow toner composition: | |
| Resin 5 | 80 parts |
| Resin A | 20 parts |
| Benzidine Yellow | 5 parts |
| Zinc salt of salicylic acid compound | 1 part |
| Magenta toner composition: | |
| Resin 5 | 80 parts |
| Resin A | 20 parts |
| Qyinacridone Red | 5 parts |
| Zinc salt of salicylic acid compound | 2 parts |
| Cyan toner composition: | |
| Resin 5 | 80 parts |
| Resin A | 20 parts |
| Copper Phthalocyanine Blue | 2 parts |
| Zinc salt of salicylic acid compound | 2 parts |
| Black toner composition: | |
| Resin 5 | 80 parts |
| Resin A | 20 parts |
| Carbon Black | 8 parts |
| Copper Phthalocyanine Blue | 1 part |
| Zinc salt of salicylic acid compound | 2 parts |

Each of the above toner compositions was mixed with Henschel mixer and kneaded with a roll mill at 100° C. for 30 minutes. Each kneaded mixture was cooled, ground with a hammer mall, finely pulverized with an air jet mill and then treated with a wind sieve device to remove extremely fine powder, thereby obtaining yellow, magenta, cyan and black toners having the particle distribution shown in Table 9 below.

TABLE 9

| Toner | Yellow | Magenta | Cyan | Black |
|---|---|---|---|---|
| Volume average particle diameter (μm) | 7.8 | 7.6 | 7.9 | 7.9 |
| Number of particles with diameter of 4 μm or less (%) | 69.0 | 58.0 | 64.0 | 68.0 |
| Volume of particles with diameter of 12 μm or more (%) | 9.0 | 1.0 | 6.0 | 5.0 |

Each of the yellow, magenta, cyan and black toners (100 parts) was mixed with 0.5 part of hydrophobic silica with Henschel mixer and the mixture (5 parts) was mixed with 95 parts of a resin-coated ferrite carrier to obtain yellow, magenta, cyan and black two-component developers. Respective developers were charged in a commercially available digital full color copying machine (PRETER650 manufactured by Ricoh Company Ltd.) . Solid patterns each having an area of 3 cm×8 cm were then produced with various toner deposition amounts of 0.2, 0.4, 0.6, 0.8 and 1.0 mg/cm$^2$ for respective colors. The fixation of the toner images was performed at 160° C., with a silicone roller with an application of an silicone oil at a linear speed of 180 mm/sec. Each of the images was measured for the density I and gloss G thereof. From the results of the measurement, the variable a, b, α and β were determined. The values a, b, α and $G_{AV}$ are shown in Table 10. The gloss was lowered in each developer.

TABLE 10

| Developer | Yellow | Magenta | Cyan | Black |
|---|---|---|---|---|
| a | 1.3 | 1.5 | 1.6 | 1.6 |
| b | 0.1 | 0.3 | 0.2 | 0.3 |
| α | 5.9 | 8.0 | 7.1 | 8.8 |
| $G_{AV}$ | 6.0 | 8.0 | 9.0 | 6.0 |

COMPARATIVE EXAMPLE 2

The following yellow, magenta, cyan and black toner compositions were prepared using Resin 1 shown above and Resin A:

| | |
|---|---|
| Yellow toner composition: | |
| Resin 1 | 80 parts |
| Resin A | 20 parts |
| Benzidine Yellow | 13 parts |
| Zinc salt of salicylic acid compound | 2 parts |
| Magenta toner composition: | |
| Resin 1 | 80 parts |
| Resin A | 20 parts |
| Qyinacridone Red | 15 parts |
| Zinc salt of salicylic acid compound | 2 parts |
| Cyan toner composition: | |
| Resin 1 | 80 parts |
| Resin A | 20 parts |
| Copper Phthalocyanine Blue | 8 parts |
| Zinc salt of salicylic acid compound | 2 parts |
| Black toner composition: | |
| Resin 1 | 80 parts |
| Resin A | 20 parts |
| Carbon Black | 14 parts |
| Copper Phthalocyanine Blue | 3 parts |
| Zinc salt of salicylic acid compound | 2 parts |

Each of the above toner compositions was mixed with Henschel mixer and kneaded with a roll mill at 100° C. for 30 minutes. Each kneaded mixture was cooled, ground with a hammer mill, finely pulverized with an air jet mill and then treated with a wind sieve device to remove extremely fine powder, thereby obtaining yellow, magenta, cyan and black toners having the particle distribution shown in Table 11 below.

TABLE 11

| Toner | Yellow | Magenta | Cyan | Black |
|---|---|---|---|---|
| Volume average particle diameter (μm) | 6.9 | 7.0 | 7.2 | 7.4 |
| Number of particles with diameter of 4 μm or less (%) | 38.0 | 35.0 | 38.0 | 36.0 |
| Volume of particles with diameter of 12 μm or more (%) | 0.0 | 0.0 | 0.0 | 0.0 |

Each of the yellow, magenta, cyan and black toners (100 parts) was mixed with 0.5 part of hydrophobic silica with Henschel mixer and the mixture (5 parts) was mixed with 95 parts of a resin-coated ferrite carrier to obtain yellow, magenta, cyan and black two-component developers. Respective developers were charged in a commercially available digital full color copying machine (PRETER650 manufactured by Ricoh Company Ltd.). Solid patterns each having an area of 3 cm×8 cm were then produced with various toner deposition amounts of 0.2, 0.4, 0.6, 0.8 and 1.0 mg/cm$^2$ for respective colors. The fixation of the toner images was performed at 160° C., with a silicone roller with an application of an silicone oil at a linear speed of 180 mm/sec. Each of the images was measured for the density I and gloss G thereof. From the results of the measurement, the variable a, b, α and β were determined. The values a, b, α and $G_{AV}$ are shown in Table 12.

TABLE 12

| Developer | Yellow | Magenta | Cyan | Black |
|---|---|---|---|---|
| a | 4.2 | 4.9 | 5.3 | 6.0 |
| b | 0.4 | 0.5 | 0.6 | 0.5 |
| α | 26.0 | 30.5 | 31.2 | 30.2 |
| $G_{AV}$ | 26.0 | 28.0 | 27.0 | 26.0 |

COMPARATIVE EXAMPLE 3

The following yellow, magenta, cyan and black toner compositions were prepared using Resin 3 shown above and Resin B:

| | |
|---|---|
| Yellow toner composition: | |
| Resin 3 | 50 parts |
| Resin B | 50 parts |
| Benzimidazolon Yellow | 6 parts |
| Zinc salt of salicylic acid compound | 2 part |
| Magenta toner composition: | |
| Resin 3 | 50 parts |
| Resin B | 50 parts |
| Brilliant Carmine 6B | 3 parts |
| Permanent Red FBB | 3 parts |
| Zinc salt of salicylic acid compound | 3 parts |
| Cyan toner composition: | |
| Resin 3 | 50 parts |
| Resin B | 50 parts |
| Copper Phthalocyanine Blue | 3 parts |
| Zinc salt of salicylic acid compound | 3 parts |
| Black toner composition: | |
| Resin 3 | 50 parts |
| Resin B | 50 parts |
| Carbon Black | 9 parts |
| Copper Phthalocyanine Blue | 1 part |
| Zinc salt of salicylic acid compound | 3 parts |

Each of the above toner compositions was mixed with Henschel mixer and kneaded with a roll mill at 100° C. for 30 minutes. Each kneaded mixture was cooled, ground with a hammer mill, finely pulverized with an air jet mill and then treated with a wind sieve device to remove extremely fine powder, thereby obtaining yellow, magenta, cyan and black toners having the particle distribution shown in Table 13 below.

TABLE 13

| Toner | Yellow | Magenta | Cyan | Black |
|---|---|---|---|---|
| Volume average particle diameter (μm) | 8.5 | 7.9 | 8.1 | 8.0 |
| Number of particles with diameter of 4 μm or less (%) | 26.0 | 21.0 | 18.0 | 24.0 |
| Volume of particles with diameter of 12 μm or more (%) | 0.0 | 0.0 | 1.0 | 1.0 |

Each of the yellow, magenta, cyan and black toners (100 parts) was mixed with 0.7 part of hydrophobic silica with Henschel mixer and the mixture (5 parts) was mixed with 95 parts of a resin-coated ferrite carrier to obtain yellow, magenta, cyan and black two-component developers. Respective developers were charged in a commercially available digital full color copying machine (PRETER650 manufactured by Ricoh Company Ltd.). Solid patterns each having an area of 3 cm×8 cm were then produced with various toner deposition amounts of 0.2, 0.4, 0.6, 0.8 and 1.0 mg/cm$^2$ for respective colors. The fixation of the toner images was performed at 160° C., with a silicone roller with an application of an silicone oil at a linear speed of 180 mm/sec. Each of the images was measured for the density I and gloss G thereof. From the results of the measurement, the variable a, b, α and β were determined. The values a, b, α and $G_{AV}$ are shown in Table 14.

TABLE 14

| Developer | Yellow | Magenta | Cyan | Black |
|---|---|---|---|---|
| a | 3.9 | 4.4 | 4.8 | 4.7 |
| b | 0.4 | 0.8 | 0.5 | 0.7 |
| α | 19.5 | 27.4 | 28.7 | 26.3 |
| $G_{AV}$ | 38.0 | 40.0 | 38.0 | 42.0 |

Using the developers in Examples 1–4 and Comparative Examples 1–3, full color images were produced. The images were evaluated for the formation of toner dispersion, image sharpness and uniformity of gloss. Further, each image was overlaid with a sheet of polyvinyl chloride and the assembly was allowed to stand at room temperature for 180 hours. Then, occurrence of transfer of the image to the polyvinyl chloride sheet was checked. Additionally, solid pattern was formed on the entire surface of paper and the resulting paper was checked for curls. The results are summarized in Table 15.

TABLE 15

| Example No. | Sharpness | Dispersion | Uniformity of Gloss | Curl | Image Transfer |
|---|---|---|---|---|---|
| 1 | good | none | good | slight | none |
| 2 | good | none | good | slight | none |
| 3 | good | none | good | slight | none |
| 4 | good | none | good | slight | none |
| Comp. 1 | good | none | no good | slight | none |
| Comp. 2 | good | none | no good | significant | none |
| Comp. 3 | good | none | no good | significant | occur |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. H9-199125, filed Jul. 10, 1997 and entitled "Toner for Dry Photography", inclusive of the specification, claims and drawings, are hereby incorporated by reference herein.

What is claimed is:

1. A toner for dry developing, comprising a colorant and a binder and giving a toner image on a transfer sheet upon fixation, said toner image having a density I and a gloss of G % when said toner deposits on said transfer sheet in an amount of M mg/cm$^2$, said I, G and M having the following relationship:

$$I=a\cdot M+b$$

where $0<a\leqq 3$ and $0\leqq b$ $$G=\alpha\cdot M+\beta$$

where $0<\alpha<15$ and $0\leqq\beta$, and $$G_{AV}\geqq 10$$

where $G_{AV}$ is an average of G when M=0.2, 0.4, 0.6, 0.8 and 1, wherein said binder comprises a first resin and a second resin having a glass transition point different from that of said first resin and greater by no more than 5° C. than that of said first resin, wherein said second resin is a styrene-acrylate copolymer having a number average molecular weight Mn of 3,000–30,000, a weight average molecular weight Mw of 9,000–50,000 and a ratio of Mw/Mn of no more than 3, and wherein the weight ratio of said first resin to said second resin is in the range of 95:5 to 60:40.

2. A toner as claimed in claim 1, wherein said first resin has a glass transition point of at least 55° C.

3. A toner as claimed in claim 2, wherein said first resin has a softening point of 100–120° C.

4. A toner as claimed in claim 1, and having a volume average particle diameter of 5–9 μm and such a particle size distribution of toner particles that particles having a diameter of 4 μm or less account for no more than 40% of the total number of said toner particles and particles having a diameter of at least 12 μm account for no more than 10% of the total volume of said toner particles.

5. A toner as claimed in claim 1, wherein said colorant is present in an amount of 3–12% by weight based on the weight of said toner and consists of carbon black and at least one additional colorant selected from the group consisting of yellow colorants, magenta colorants and cyan colorants, said additional colorant being present in an amount of 10–30% by weight based on the weight of said carbon black.

6. A toner as claimed in claim 1, wherein said colorant is a yellow colorant and is present in an amount of 4–10% by weight based on the weight of said toner.

7. A toner as claimed in claim 1, wherein said colorant is a magenta colorant and is present in an amount of 4–10% by weight based on the weight of said toner.

8. A toner as claimed in claim 1, wherein said colorant is a cyan colorant and is present in an amount of 1–5% by weight based on the weight of said toner.

9. A toner for dry developing, comprising a colorant, and a binder including a first resin and a second resin having a glass transition point different from that of said first resin and greater by no more than 5° C. than that of said first resin, wherein said first resin has a glass transition point of at least 55° C. and a softening point of 100–120° C., wherein said second resin has a number average molecular weight Mn of 3,000–30,000, a weight average molecular weight Mw of 9,000–50,000 and a ratio of Mw/Mn of no more than 3, and wherein the weight ratio of said first resin to said second resin is in the range of 95:5 to 60:40.

10. A toner as claimed in claim 9, wherein the first resin is a polyol resin which is either (A) a resin having (i) a main skeleton containing an epoxy resin unit and an alkylene oxide unit and (ii) inert terminal ends, or (B) a resin obtained by reacting (a) an epoxy resin, (b) an alkylene oxide addition product of a dihydric phenol compound or a glycidyl ether of the product, (c) a compound having one active hydrogen capable of reacting with the epoxy resin (a), and (d) a compound having at least two active hydrogens capable of reacting with the epoxy resin (a).

11. A toner as claimed in claim 9, and having a volume average particle diameter of 5–9 $\mu$m and such a particle size distribution of toner particles that particles having a diameter of 4 $\mu$m or less account for no more than 40% of the total number of said toner particles and particles having a diameter of at least 12 $\mu$m account for no more than 10% of the total volume of said toner particles.

12. A toner as claimed in claim 9, wherein said colorant is present in an amount of 3–12% by weight based on the weight of said toner and consists of carbon black and at least one additional colorant selected from the group consisting of yellow colorants, magenta colorants and cyan colorants, said additional colorant being present in an amount of 10–30% by weight based on the weight of said carbon black.

13. A toner as claimed in claim 9, wherein said colorant is a yellow colorant and is present in an amount of 4–10% by weight based on the weight of said toner.

14. A toner as claimed in claim 9, wherein said colorant is a magenta colorant and is present in an amount of 4–10% by weight based on the weight of said toner.

15. A toner as claimed in claim 9, wherein said colorant is a cyan colorant and is present in an amount of 1–5% by weight based on the weight of said toner.

* * * * *